US007739886B2

(12) United States Patent
Okamoto

(10) Patent No.: US 7,739,886 B2
(45) Date of Patent: Jun. 22, 2010

(54) KNITWEAR HAVING OPEN PART IN BODY TUBULAR PART, AND METHOD OF KNITTING THE SAME

(75) Inventor: Kazuyoshi Okamoto, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 239 days.

(21) Appl. No.: 11/915,920

(22) PCT Filed: May 31, 2006

(86) PCT No.: PCT/JP2006/310839

§ 371 (c)(1),
(2), (4) Date: Nov. 29, 2007

(87) PCT Pub. No.: WO2006/129686

PCT Pub. Date: Dec. 7, 2006

(65) Prior Publication Data

US 2009/0308108 A1 Dec. 17, 2009

(30) Foreign Application Priority Data

Jun. 1, 2005 (JP) ..... 2005-162038

(51) Int. Cl.
*D04B 7/04* (2006.01)

(52) U.S. Cl. ..... 66/64; 66/176

(58) Field of Classification Search ..... 66/64, 66/176, 70, 169 R, 69, 75.1, 68, 170
See application file for complete search history.

(56) References Cited

U.S. PATENT DOCUMENTS 3,474,643 A * 10/1969 Chell et al. ..... 66/70

(Continued)

FOREIGN PATENT DOCUMENTS

JP 47-38230 A 12/1972

(Continued)

*Primary Examiner*—Danny Worrell
(74) *Attorney, Agent, or Firm*—Rothwell, Figg, Ernst & Manbeck, P.C.

(57) ABSTRACT

A method of knitting a knitwear having an open part with a desired shape in which overlapping state of the open part is freely designed; the method comprising the steps of (a) to (f):

a) a body is knitted by return knitting up to a joining starting location with a open part as a turn back position, wherein a right and left bodies are abutted at an overlapping portion of the open part, and a boundary of the front and back knitted is positioned on the needle bed on which the back body is assigned;

b) rotating the body so that one of the boundaries is positioned between the front and back needle beds;

c) joining the body and one of the left and right sleeve tubular parts (sleeve) to form one tubular part at one of the boundaries of the body and a joining side boundary of the sleeve;

d) rotating the tubular part formed in step c so that the other boundary of the body is positioned between the front and back needle beds;

e) joining the body and the other sleeve to form one tubular part at the other boundary of the body and a joining side boundary of the sleeve; and f) knitting the tubular part formed in step e by return knitting towards shoulder parts with the open part as a turn-back position.

7 Claims, 5 Drawing Sheets

U.S. PATENT DOCUMENTS

| | | | | |
|---|---|---|---|---|
| 3,640,097 | A * | 2/1972 | Betts et al. | 66/176 |
| 5,916,272 | A * | 6/1999 | Nonnenmacher et al. | 66/69 |
| 5,987,930 | A * | 11/1999 | Nakai | 66/69 |
| 6,286,340 | B1 * | 9/2001 | Yui | 66/70 |
| 6,550,284 | B2 * | 4/2003 | Okamoto | 66/69 |
| 6,658,899 | B2 * | 12/2003 | Okamoto | 66/64 |
| 6,668,593 | B2 * | 12/2003 | Okamoto | 66/64 |
| 6,668,594 | B2 | 12/2003 | Okuno | |
| 6,672,113 | B2 * | 1/2004 | Okamoto | 66/76 |
| 6,766,667 | B2 | 7/2004 | Dohtsu et al. | |
| 6,889,530 | B2 * | 5/2005 | Urano et al. | 66/64 |
| 6,935,140 | B2 * | 8/2005 | Okamoto | 66/69 |
| 6,988,384 | B2 * | 1/2006 | Okamoto | 66/64 |
| 7,143,613 | B2 * | 12/2006 | Takimoto | 66/64 |
| 7,168,271 | B2 * | 1/2007 | Yui | 66/64 |
| 7,181,309 | B2 * | 2/2007 | Kazuyoshi | 700/141 |
| 7,212,881 | B2 * | 5/2007 | Kazuyoshi | 700/141 |
| 7,222,504 | B2 * | 5/2007 | Nakayama | 66/64 |
| 7,481,078 | B2 * | 1/2009 | Okamoto | 66/70 |
| 2005/0028562 | A1 * | 2/2005 | Urano et al. | 66/170 |

FOREIGN PATENT DOCUMENTS

| | | | |
|---|---|---|---|
| JP | 2001-073212 | A | 3/2001 |

* cited by examiner

KNITWEAR HAVING OPEN PART IN BODY TUBULAR PART, AND METHOD OF KNITTING THE SAME

CROSS REFERENCE TO RELATED APPLICATION

This application is a 35 U.S.C. 371 National Phase Entry Application from PCT/JP2006/310839, filed May 31, 2006, which claims the benefit of Japanese Patent Application No. 2005-162038 filed on Jun. 1, 2005, the disclosure of which is incorporated herein in its entirety by reference.

TECHNICAL FIELD

The present invention relates to a method of knitting a knitwear having an open part in a body tubular part formed by joining the body tubular part and sleeve tubular parts, which are knitted in a seamless manner using a flat knitting machine, in a seamless manner.

BACKGROUND ART

Knitwear having an open part in a body tubular part may include, for example, cardigan, jacket, or one-piece dress having slit formed at the hem, and the like. When knitting a cardigan using a flat knitting machine, a front body is divided into a right front body and a left front body, and open parts are formed in the left and right front bodies. The cardigan is knitted similar to when knitting a sweater with overlapping portions of the open part of the right front body and the open part of the left front body abutted to each other. Specifically, a body is knitted from a hem part, sleeves are knitted from a cuff part, and the sleeves are knitted in a continuous tubular form while the body is knitted in a discontinuous tubular form at the middle of a front body. The body tubular part and the sleeve tubular parts are then joined together at the armhole parts.

In the case of a cardigan, an open part is normally closed by buttons, and thus a front body is knitted so that the closing portions of the open parts overlap. Since such overlapping portions are necessary in the front body, the length in a knitting width direction of the knitted fabric of the entire front body with the right front body and the left front body abutted at the overlapping portion of the open parts becomes longer than the length in the knitting width direction of the knitted fabric of the back body.

Conventionally, as shown in Patent Document 1, the body tubular part is knitted so that the number of loops held on a front needle bed and the number of loops held on a back needle bed become substantially the same up to an armpit position. Since the loops held on the front and back needle beds are substantially the same number, the body is knitted in a tubular form by return knitting through a so-called C-shaped knitting with an appropriate number of loops forming the side part of the front body rotated toward the needle bed on which the loops of the knitted fabric of the back body are held. In other words, the front and back bodies are knitted in a tubular form through the C-shaped knitting with the boundary of the knitted fabric of the front body and the knitted fabric of the back body positioned on the back needle bed on which the loops of the knitted fabric of the back body are held.

In the knitting method shown in Patent Document 1, knitting is performed while reducing the loops on the knitted fabric of the front body so that the boundary of the front and back knitted fabrics of the body is positioned between the front and back needle beds before joining the body tubular part and the sleeve tubular parts. Specifically, knitting is performed with an opening formed at the open part widened in a V-neck shape by reducing the loops of the front body. Simultaneously, the loops on the boundary side of the front body rotated toward the back body side are returned to the front needle bed using empty needles obtained by reducing the loops. By thus knitting, the loops of the knitted fabric of the front body are all held on the front needle bed and the loops of the knitted fabric of the back body are all held on the back needle bed at the armpit, that is, a joining starting position of the body tubular part and the sleeve tubular parts. Knitting is then performed in such a state towards the shoulder while integrating and return knitting the sleeve tubular parts and the body tubular part in a tubular form.

In Patent Document 1, the following two methods are proposed as a knitting method of joining while reducing the loops of the front body. In one method, the boundary of the right front body and the back body is positioned between the front and back needle beds, and the boundary of the left front body and the back body is rotated toward the back needle bed on which the fabric part of the back body is held. After the loops of the left and right front bodies at the end on the open part side are reduced, the loops rotated toward the back needle bed are transferred to the front needle bed so that the boundary of the left front body is positioned between the front and back needle beds. Then, the joining of the body tubular part and the sleeve tubular parts starts.

In the other method, the boundaries of the front and back knitted fabrics of the left and right front bodies are rotated toward the back needle bed on which the knitted fabric of the back body are held. After the loops at the end on the open part side of the left and right front bodies are reduced, the loops rotated toward the back needle bed are transferred to the front needle bed so that the boundaries of the left and right front bodies are positioned between the front and back needle beds. Then, the joining of the body tubular part and the sleeve tubular parts starts.

Patent Document 1: Pamphlet of International Publication No. 2002/070800

DISCLOSURE OF THE INVENTION

Problem to be Solved by the Invention

However, in the knitting method described in Patent Document 1, the body tubular part and the left and right sleeve tubular parts are simultaneously joined, and thus joining must be performed with the boundary of the front and back knitted fabrics in each tubular part positioned between the front and back needle beds at the point of starting the joining of the body tubular part and the sleeve tubular parts. Thus, in order to simultaneously join the body tubular part and the left and right sleeve tubular parts, the loops of the knitted fabric of the front body rotated to the back body side must be returned to the front needle bed at the armpit or the joining starting position. Therefore, the overlapping portions of the open parts are always formed at a position below the armpit, that is, a position below the joining starting position of the body tubular part and the sleeve tubular parts.

In the knitting method shown in Patent Document 1, consideration is not made in forming the overlapping portions of the open parts at a position above the armpits, that is, a position above the joining starting positions of the body tubular part and the sleeve tubular parts when knitting the cardigan in a seamless manner using the flat knitting machine. Thus, a knitting method for forming an opening of a low-cut V-neck type or an opening of a round neck type is necessary.

It is an object of the present invention to provide a knitwear having the open part in the body tubular part in which the overlapping state of the open parts can be freely designed and knitted so that the shape of the opening of the knitwear has a desired shape even when knitting the knitwear having the open part in the body tubular part in a seamless manner; and a method of knitting the same.

Means for Solving the Problem

A method of knitting a knitwear having an open part in the body tubular part of the present invention is a knitting method of knitting a knitwear, in which a tubular part forming a body (hereinafter also referred to as a body tubular part) and tubular parts forming sleeves (hereinafter also referred to as sleeve tubular parts) are joined with each other and the body tubular part has an open part, using a flat knitting machine having a pair of front and back needle beds extending in a transverse direction and disposed opposite to each other in a cross direction, at least either of which is capable of being racked in the transverse direction so that loops can be transferred between the front and back needle beds.

The knitting method of the present invention includes the following steps of:

a) knitting the body tubular part having the front body and the back body by return knitting up to a joining starting position to form a tubular part, wherein either the front body or the back body is divided into a right body and a left body having an open part respectively, overlapping portions of the open parts of the bodies are abutted to each other, the boundary of front and back knitted fabrics of the bodies is positioned on the needle bed holding loops of the body not having the open part, and the open part is a turn-back position;

b) rotating the body tubular part so that one of the left and right boundaries of the body tubular part is positioned between the front and back needle beds;

c) joining the body tubular part and one of the sleeve tubular parts to form one tubular part with one boundary of the body tubular part and a joining side boundary of one of the left and right sleeve tubular parts facing each other;

d) rotating the tubular part formed in step c so that the other boundary of the body tubular part is positioned between the front and back needle beds;

e) joining the body tubular part and the sleeve tubular part to form one tubular part with the other boundary of the body tubular part and a joining side boundary of the other sleeve tubular part facing each other; and f) knitting the tubular part formed in step e by return knitting towards shoulder parts with the open part as a turn-back position.

In the present invention, the body tubular part includes open parts, and thus is not a complete tubular form. However, the overlapping portions of the open parts are overlapped to close when the knitwear is worn, and thus a tubular form is obtained when the open parts are overlapped. In the present invention, during the knitting by the flat knitting machine, the body tubular part in which the overlapping portions of the open parts are abutted to each other is defined as a tubular form, and after completion of the knitwear, the state in which the overlapping portions of the open parts are overlapped to close is defined as the tubular form.

The position of the boundary of the body tubular part on the needle beds at immediately before joining with the sleeve tubular parts is virtually set according to the overlapping state of the designed open parts before the joining.

The boundary of the body tubular part is set such that when the joining of the tubular parts is completed, the length in the knitting width direction of the knitted fabric of the body having the open part, either the front or the back body, is longer than the length in the knitting width direction of the knitted fabric of the other body, regardless of gore formation.

For example, a case of joining the body tubular part and one of the sleeve tubular parts includes a case of joining without gore formation, a case of joining with formation of gores such that the length of the gores is the same between the front and back knitted fabrics, and a case of joining with formation of the gores such that the length of the gores differs between the front and back knitted fabrics. In any case, the boundary is set for the knitted fabric portion excluding the joining portion such that the length in the knitting width direction of the knitted fabric of either the front or the back body having the open part becomes longer than the length in the knitting width direction of the knitted fabric of the other body.

Furthermore, the sleeve tubular part preferably has the boundary of the front and back knitted fabrics on the side to be joined with the body tubular part set to be positioned on one of the needle beds immediately before joining. At the boundary of the sleeve tubular parts, the position of the boundary on the needle bed at immediately before joining is virtually set with respect to the sleeve tubular parts before joining is performed. When the sleeve tubular parts have the boundary positioned on one of the needle beds at immediately before joining, the sleeve tubular parts are rotated so that the joining side boundary is positioned between the front and back needle beds in step b and step d. In this case, even if the length in the knitting width direction of the front and back knitted fabrics is the same before start of joining, the sleeve tubular parts may be rotated so that one boundary positioned on the front needle bed and the other boundary positioned on the back needle bed are positioned between the needle beds. If the length in the knitting width direction of the front and back knitted fabrics of the sleeve tubular part differs before joining, the sleeve tubular parts are rotated so that the joining side boundary of the sleeve tubular parts positioned on one of the needle beds is positioned between the front and back needle beds.

In the setting of the boundary, the boundary may be set at a stage of starting to knit the tubular part so as to be at a predetermined position immediately before joining for the body tubular part and for the sleeve tubular parts, the boundary may be set at a stage of knitting to the joining starting position, or the boundary may be set immediately before start of joining. The stage of starting to knit the tubular part refers to the time point of starting to knit the cuff part or the hem knitted with rib knitting, or the time point of starting to knit the knitted fabric part following the completion of the cuff part or the hem knitted with rib knitting.

When the body tubular part and one of the sleeve tubular parts are joined, the front knitted fabrics and the back knitted fabrics are joined through double stitching in the knitting in step c and step e. The double stitching may be performed on one loop or a plurality of loops. The gores can be formed at the joining portion in the case where the number of double stitches increases.

When the body tubular part and one of the sleeve tubular parts are joined, the front knitted fabrics and the back knitted fabrics are knitted with the boundaries therebetween by double stitching and bind-off processing to join them in the case of the presence of the gores.

When the gores are formed at the joining portion, the size of the gores may differ between the front and back knitted fabrics. In this case, the number of loops to be bound off is differed between front and back knitted fabrics.

Furthermore, the knitwear can be knitted to a shape that fits the human body by differing the length in the knitting width direction of the front and back knitted fabrics in the tubular parts in which joining is completed in addition to differing the size of the front and back gores. A case in which the length of the gores differs between the front knitted fabric and the back knitted fabric includes a case in which the gore is not formed on one of the knitted fabrics.

Knitwear having the open part in the body tubular part according to the present invention includes cardigan, jacket, open front dress, open back dress, and the like. When knitting the open front knitwear, the front body is divided into the right front body and the left front body. The front and back knitted fabrics of the body are knitted in a tubular form to form an open part in the right front body and the left front body, and the body tubular part and the sleeve tubular parts are joined.

When knitting the open front knitwear, the boundary of the knitted fabric of the front body and the knitted fabric of the back body is set such that the length in the knitting width direction of the knitted fabric of the entire front body becomes longer than the length in the knitting width direction of the knitted fabric of the back body according to the shape of the designed open front knitwear such as shape of the open part of the front body, the overlapping amount of the open part, and the like.

Furthermore, when knitting the open front knitwear, the body tubular part can be knitted so that the overlapping portions of the open parts extend from the hem to above the joining starting position of the body tubular part and sleeve tubular parts. By forming the open parts in this manner, an opening of the open parts can be formed above the joining starting position of the body tubular part and the sleeve tubular parts. The opening refers to the portion formed above the overlapping portions of the left and right open parts wherein the left and right open parts do not overlap, and continuing to the neck line. The shape of the opening includes V-neck, U-neck, round neck, and the like. Furthermore, the overlapping portions of the open parts may be formed at the center portion of the body, or may be formed at the position shifted to the left and the right from the center portion.

The rotation of the tubular part refers to the operation of rotating the entire knitted fabric while transferring loops positioned on the diagonal line at both ends in the knitting width of the tubular part assigned on the needle beds to the needles of the opposing needle bed.

The present invention provides an open front knitwear in which the front body is divided into a right front body and a left front body, an open part is formed in the right front body and the left front body, the body tubular part is knitted in a seamless manner so that overlapping portions of the open parts extend from the hem part to above the joining starting position of the body tubular part and the sleeve tubular parts, and the body tubular part and the sleeve tubular parts are joined in a seamless manner, by the knitting method using the flat knitting machine having needle beds provided with a great number of knitting needles disposed opposite to each other in a cross direction.

EFFECT OF THE INVENTION

The knitwear having an open part in the body tubular part has the length in the knitting width direction of the entire knitted fabric of either the front body or the back body having the open part longer than the length in the knitting width direction of the knitted fabric of the other body. In the method of knitting the knitwear having the open part in the body tubular part according to the present invention, the body tubular part is rotated so that the joining side boundary is positioned between the front and back needle beds even if the length in the knitting width direction of the knitted fabrics of the front and back bodies differs, and thereafter, the body tubular part is joined with one of the sleeve tubular parts at the joining side boundary to form one tubular part. The integrated tubular part is then rotated so that the boundary of the bodies is positioned between the front and back needle beds, and the other sleeve tubular part is joined thereto. According to such knitting method, the left and right sleeve tubular parts can be joined to the body tubular part at the boundary.

Since the body tubular part and the left and right sleeve tubular parts are joined in such manner, the joining is not restricted by the shape of the open part or the overlapping amount of the open part.

As a result, the knitting of cardigan having an open part of round neck, U-neck, and low V-neck, which could not be knitted in the prior art, becomes possible.

Furthermore, the sleeves can be in a natural position even when wearing the knitwear with the open parts overlapped since the joining starting location of the body tubular part and the sleeve tubular parts is determined in view of the width of the overlapping portion of the open part, whereby a beautiful silhouette can be obtained.

DETAILED DESCRIPTION OF THE PREFERRED EMBODIMENTS

The preferred embodiments of the present invention will now be described in detail based on the drawings. The embodiments described below relate to manufacturing of a cardigan of round-neck type using a so-called two-bed flat knitting machine having at least a pair of front and back needle beds extending in a transverse direction and disposed opposite to each other in a cross direction, the back needle bed capable of being racked in the transverse direction so that loops can be transferred between the front and back needle beds. Only the method of knitting the cardigan of round-neck type will be described in the following embodiment, but obviously, cardigans of U-neck type or low cut V-neck type can also be knitted. The position of forming the overlapping portions of the open parts is at the center in the width direction of the body in the following embodiments, but the overlapping portions of the open parts may be formed at a position shifted to the left or the right with respect to the center of the body.

In each embodiment described above, when the knitted fabric part of tubular form is knitted with the two-bed flat knitting machine, it is knitted with every other needles of each of the front and back needle beds. For example, the knitted fabrics of the front body (hereinafter referred to as front knitted fabrics) of the body tubular part and the front knitted fabrics of the sleeve tubular part are knitted primarily with odd-numbered needles of the front needle bed, and the knitted fabrics of the back body (hereinafter referred to as back knitted fabrics) of the body tubular part and the back knitted fabrics of the sleeve tubular part are knitted primarily with even-numbered needles of the back needle bed.

Furthermore, in the two-bed flat knitting machine, the needles of the back needle bed opposing the needles on which the loops are held in the front needle bed become empty needles when knitting the front knitted fabrics on the front needle bed, and the needles of the front needle bed opposing the needles on which the loops are held in the back needle bed become empty needles when knitting the back knitted fabric on the back needle bed. This can provide the result that the empty needles used for loop transfer of the respective front and back knitted fabrics can always be kept on the opposite needle beds in the two-bed flat knitting machine.

Through the use of these empty needles, structure patterns of mixed front-and-back stitches, such as links, purl stitches, and ribs, can be knitted and the front and back loops can be transferred in the knitting width direction so as to be joined with each other in the two-bed flat knitting machine.

When the two-bed flat knitting machine is used, a transfer jack bed(s) having transfer jacks arranged in line thereon and located over either or both of the front and back needle beds may be used to knit knitted fabrics.

The cardigan is knitted using the two-bed flat knitting machine in the present embodiment. However, a four-bed flat knitting machine including an upper front needle bed, a lower front needle bed, an upper back needle bed, and a lower back needle bed may be used for knitting.

When the four-bed flat knitting machine is used, for example, the front knitted fabrics are knitted principally on the lower front needle bed and the back knitted fabrics are knitted principally on the lower back needle bed. Then, upper back needle bed is used in the form of empty needles for loop transfer of the front knitted fabrics and back stitch formation thereof and so on when the front knitted fabrics are knitted, and the upper front needle bed is used in the form of empty needles for loop transfer of the back knitted fabrics and back stitch formation thereof and so on when the back knitted fabrics are knitted.

First Embodiment

FIG. 1 is a plan view of parts of the cardigan according to a first embodiment whose body and sleeves are viewed from the front body side. FIG. 2 is a knitting process drawing of a cardigan 101 knitted by the knitting method of the present invention.

The cardigan 101 knitted in the first embodiment is a long-sleeved cardigan with a round neckline, having a body 2, a left sleeve 3, and a right sleeve 4. The body 2 is configured by a right front body 201*a*, a left front body 202*a*, and a back body 2*b*.

The right front body 201*a*, the left front body 202*a*, and the back body 2*b* have a hem part 81, side parts 82, armhole parts 83, and a neckline part 84, as shown in FIG. 1. In the embodiment, the front body is divided into the right front body 201*a* and the left front body 202*a* to form an open shape, wherein an open part S1 is formed in the right front body 201*a* and an open part S2 is formed in the left front body 202*a*. One part (part other than an opening that becomes a part of the neckline part 84) of the open parts S1, S2 overlaps to close the front body.

In the present embodiment, the body is formed to open front, so that the open parts S1, S2 other than the opening can be overlapped. Thus, when the right front body 201*a* and the left front body 202*a* are abutted at the overlapping portions of the open parts S1, S2, the length in the knitting width direction of the entire front body obtained by adding the length in the knitting width direction of the knitted fabric of the right front body 201*a* and the length in the knitting width direction of the knitted fabric of the left front body 202*a* becomes longer than the length in the knitting width direction of the knitted fabric of the back body 2*b*. In the left sleeve 3 and the right sleeve 4, the width dimension of the front knitted fabrics 3*a*, 4*a* and the width dimension of the back knitted fabrics 3*b*, 4*b* are of the same size.

In the present embodiment, the body is knitted by return knitting in a tubular form so that the right front body 201*a*, the back body 2*b*, and the left front body 202*a* become continuous with the open parts S1, S2 of the right front body 201*a* and the left front body 202*a* as the turn-back position. The left and right sleeves 3, 4 are circling knitted in a tubular form.

In the present embodiment, the term representing left and right of the body and the sleeve, for example, right and left of the left sleeve 3 and the right sleeve 4 assumes a wearer wearing the cardigan 101 as the reference.

Although the body 2 has an open part in the front body, the body is formed in a tubular form since the overlapping portions of the open parts S1, S2 of the right front body 201*a* and the left front body 202*a* are in an abutted state until the body 2 and the sleeves 3, 4 are joined. In the present embodiment, the body tubular part is simply referred to as the body 2 and the left and right sleeve tubular parts are referred to as right sleeve 4 and left sleeve 3.

A knitting procedure of the cardigan 101 of the present embodiment is described below. In the embodiment, the back body 2*b*, and the back knitted fabrics 3*b*, 4*b* of the left sleeve 3 and the right sleeve 4 are knitted primarily using even-numbered needles on the back needle bed. The knitted fabric of the right front body 201*a*, the knitted fabric of the left front body 202*a*, and the front knitted fabrics 3*a*, 4*a* of the left sleeve 3 and the right sleeve 4 are knitted primarily using odd-numbered needles on the front needle bed.

For the sake of convenience of the explanation, the knit structure of the right front body 201*a*, the left front body 202*a*, the back body 2*b*, and the sleeves 3, 4 of the cardigan 101 is presented in the form of a plain knit structure with no pattern, and the knit structure of the hem parts 81 of the right front body 201*a*, the left front body 202*a* and the back body 2*b* and the cuff parts 30, 40 of the sleeves 3, 4 are presented in the form of a rib knit structure. However, the right front body 201*a*, the left front body 202*a*, the back body 2*b*, the right sleeve 4 and the left sleeve 3 may have another knit structure, such as jacquard and rib.

First, three yarn feeders are prepared for the knitting of the body and the knitting of the right and left sleeves, so that knitting yarns are fed from the respective yarn feeders to needles of the needle beds to knit three tubular bodies of the right sleeve, the body, and the left sleeve, respectively.

Specifically, the right front body 201*a*, the left front body 202*a*, and the back body 2*b* are knitted in a tubular form from the hems up to the joining starting location (A, a, C, c) with the sleeves while knitting by return knitting (C-shaped knitting) with the open parts S1, S2 of the right front body 201*a* and the left front body 202*a* in the abutted state, as shown in FIG. 1. The left sleeve 3 and the right sleeve 4 are circling knitted in a tubular form from the cuff parts up to the joining starting position (E, e, G, g) with the body.

Then, the joining of the body 2 and the left sleeve 3 starts at point A of the left front body 202*a*, point E and point G of the left sleeve 3, and point C of the back body 2*b*. The joining of the body 2 and the right sleeve 4 starts at point a of the right front body 201*a*, point e and point g of the right sleeve 4, and point c of the back body 2*b*. In the embodiment, the body 2, the left sleeve 3, and the right sleeve 4 are knitted as separate tubular knitted fabrics until the start of the joining of the body and the sleeves.

Furthermore, in the embodiment, point A and point C become the boundary Z of the left front body 202*a* and the back body, and point a and the point c become the boundary Z of the right front body 201*a* and the back body 2*b*, when the body 2 is knitted in the tubular form, as shown in FIG. 2. Moreover, as shown in FIG. 2, point E and point G become a boundary Y on the joining side of the front knitted fabric 3*a* and the back knitted fabric 3*b* when the left sleeve 3 is knitted in a continuous tubular form, and point e and point g become a boundary X on the joining side of the front knitted fabric 4*a* and the back knitted fabric 4*b* when the right sleeve 4 is knitted in a continuous tubular form.

In the present embodiment, the gores are formed by A-B of the left front body 202*a*, a-b of the right front body 201*a*, C-D, c-d of the back body 2*b*, E-F of the front knitted fabric 3*a* of the left sleeve 3, G-H of the back knitted fabric 3*b* of the left sleeve 3, e-f of the front knitted fabric 4*a* of the right sleeve 4, and g-h of the back knitted fabric 4*b* of the right sleeve 4. A-B of the left front body 202*a* and E-F of the front knitted fabric 3*a* of the left sleeve 3 are joined together, and a-b of the right front body 201*a* and *e-f* of the front knitted fabric 4*a* of the right sleeve 4 are joined together. Furthermore, C-D of the back body 2*b* and G-H of the back knitted fabric 3*b* of the left sleeve 3 are joined together, and c-d of the back body 2*b* and *g-h* of the back knitted fabric 4*b* of the right sleeve 4 are joined together. In the present embodiment, the length of the gores of the front knitted fabrics are made the same as the length of the gores of the back knitted fabrics. When the joining of the gore portions is completed, the body and the sleeves are combined as a single tubular body.

After the joining of the body 2 and the left and right sleeves 3, 4 starts, the tubular part in which the body 2 and the left and right sleeves 3, 4 are joined and integrated is knitted by return knitting with the open parts S1, S2 as a turn-back position while reducing loops towards the shoulder so that the left and right sleeves 3, 4 are joined to the armhole parts 83 of the body. After the joining of the body 2 and the sleeves 3, 4 is completed, the remaining shoulder parts of the body are knitted, and the front body and the back body at the shoulder parts are joined to complete the cardigan 101.

In the present embodiment, the gore portion (in number of wales) of the front knitted fabric and the gore portion (in number of wales) of the back knitted fabric are of the same size for the body 2 and the sleeves 3, 4. However, regarding the length in the knitting width direction (in number of wales) of the front and back knitted fabrics of the body 2, the length in the knitting width direction of the front knitted fabric (knitted fabric part of the entire front body) becomes longer than the length in the knitting width direction of the back knitted fabric. Therefore, the body and the sleeves are joined through a knitting method shown in the knitting process drawing shown in FIG. 2 in the present embodiment.

The method of knitting and joining of the cardigan 101 of the present embodiment will be specifically described based on FIG. 2. The knitting process drawing of FIG. 2 shows the knitting method from immediately before the start of joining of the body 2 and the sleeves 3, 4 up to right before joining of the shoulder parts after the gore formation is completed. The numerals at the left side of FIG. 2 indicate the respective steps of the knitting processes, and the square figures shown in each step show the state of the knitted fabric of tubular form. The line at the lower part of the square figure indicates the knitted fabric held on the needle of the front needle bed, and the line at the upper part indicates the knitted fabric held on the needle of the back needle bed. Furthermore, X, Y, and Z marked on the line of the square figure indicate the boundary of the front knitted fabric and the back knitted fabric. This is the same for the knitting process drawing used in other following embodiments.

The body 2 and the left and right sleeves 3, 4 are knitted through the following knitting processes, where the left and right sleeves 3, 4 are sequentially joined to the body 2.

Step 1 shown in FIG. 2 shows a state in which the body 2 and the left and right sleeves 3, 4 are individually knitted in a tubular form up to immediately before the start of joining of the body 2 and the sleeves 3, 4. The center is the body 2, and the left and right sleeves 3, 4 are knitted on both sides thereof. In FIG. 2, the boundary of the right front body 201*a* and the back body 2*b* of the body, and the boundary of the left front body 202*a* and the back body 2*b* are indicated as Z. The boundary of the front knitted fabric 3*a* and the back knitted fabric 3*b* is indicated as Y, Y for the left sleeve 3, and the boundary of the front knitted fabric 4*a* and the back knitted fabric 4*b* is indicated as X, X for the right sleeve 4. Furthermore, the dividing area of the left front body 202*a* and the right front body 201*a* of the body 2 is the open parts S1, S2. In step 1, the open part S1 of the right front body 201*a* and the open part S2 of the left front body 202*a* are abutted to each other.

In step 1, the boundaries Z of the body 2 are positioned so as to be symmetric with respect to the center in the knitting width of the knitted fabric on the back needle bed. The boundaries Y of the left sleeve 3 and the boundaries X of the right sleeve 4 are symmetric with respect to the center in the knitting width so that the boundaries on the joining side with the body 2 are positioned on the front needle bed, and the other boundaries are positioned on the back needle bed. In the present embodiment, the boundaries Z of the body 2 are set so that the number of loops in the knitting width direction of the back knitted fabric is less than the number of loops in the knitting width direction of the entire front knitted fabric, and the boundaries Y of the left sleeve 3 and the boundaries X of the right sleeve 4 are set so that the number of loops in the knitting width direction of the front and back knitted fabrics are the same.

The knitted fabrics of the body 2 are rotated clockwise so that the boundary Z on the side to be joined with the left sleeve 3 is positioned between the front and back needle beds with the overlapping portions of the open parts S1, S2 of the left front body 202*a* and the right front body 201*a* abutted to each other. The left sleeve 3 is brought close to the body 2 while being rotated clockwise to have the joining side boundary Y positioned between the front and back needle beds, so that the body 2 and the left sleeve 3 become adjacent to each other (step 2). The boundary Z of the body 2 and the boundary Y of the left sleeve 3 are thus opposed between the front and back needle beds by the operation of step 2.

The body 2 and the left sleeve 3 are then joined from the boundaries Z, Y from the state of step 2. Specifically, the body 2 and the left sleeve 3 are joined by performing double stitching and thereafter performing a bind-off process between the front knitted fabrics and the back knitted fabrics from the boundaries Z, Y. The formation of gores is performed, with respect to the body 2, from point A to point B for the front knitted fabric (knitted fabric of left front body 202*a*) and from point C to point D for the back knitted fabric (knitted fabric of back body 2*b*), and with respect to the left sleeve 3, from point E to point F for the front knitted fabric 3*a* and from point G to point H for the back knitted fabric 3*b* (step 3). The state of step 4 is obtained at the point joining through the bind-off process is terminated. The body 2 and the left sleeve 3 are joined in the state of step 4 to form a single tubular body.

After the body 2 and the left sleeve 3 are joined and the formation of the gore is completed, the right sleeve 4 is brought close to the body 2. The right sleeve 4 is brought close to the body 2 while being rotated counterclockwise to have the joining side boundary X positioned between the front and back needle beds so as to be adjacent to the body 2. The tubular part in which the body 2 and the left sleeve 3 are integrated is rotated counterclockwise so that the boundary Z on the side to be joined with the right sleeve 4 is positioned between the front and back needle beds (step 5). The boundary Z of the body 2 and the boundary X of the right sleeve 4 then oppose each other between the front and back needle beds by the operation of step 5.

The body 2 and the right sleeve 4 are then joined from the boundaries Z, X from the state of step 5. Specifically, the body 2 and the right sleeve 4 are joined by performing double stitching and thereafter performing a bind-off process between the front knitted fabrics and the back knitted fabrics from the boundaries Z, X. The formation of gores is performed, with respect to the body 2, from point a to point b for the front knitted fabric (knitted fabric of right front body 201*a*) and from point c to point d for the back knitted fabric (knitted fabric of back body 2*b*), and with respect to the right sleeve 4, from point e to point f for the front knitted fabric 4*a* and from point g to point h for the back knitted fabric 4*b* (step 6). The state of step 7 is obtained at the point joining through the bind-off process is terminated. The left sleeve 3 and the right sleeve 4 are joined to the body 2 in the state of step 7 to form a single tubular body.

The tubular part is rotated clockwise so that the non-joining side boundary X on the right sleeve, the non-joining side boundary Y on the left sleeve and the left and right joining parts X, Z and Y, Z are symmetric with the open parts S1, S2 as the center, and the state of step 8 is obtained. The body 2 and the left and right sleeves 3, 4 are then continuously knitted in a tubular form from the above state so as to be joined up to the shoulder part.

The state of step 9 is a cross section at the joining starting position of the body and the sleeves when the shoulder parts are joined and the knitting of the cardigan is completed. In step 9, the open part S1 of the right front body 201*a* and the open part S2 of the left front body 202*a* are in an overlapping state. In the present embodiment, the overlapping portions of the open parts as shown in FIG. 1 extend to above the joining starting position of the body and the sleeves, and thus the cardigan having a round neck opening can be knitted.

Normally, when the tubular part is rotated, the loops transferred from one needle bed to the other needle bed become twisted. If the position of the boundary with respect to the end in the knitting width of the knitted fabric held on the needle bed after the formation of the gores is different from the position immediately before the start of joining, the loops in a twisted state remain on the needle bed, accordingly, loops are continuously formed on the twisted loops.

Therefore, in the present embodiment, the non-joining side boundaries X, Y of the left and right sleeves 3, 4 are set so that the position of each boundary after the formation of the gores in step 8 is at the same position as the position at immediately before the start of the joining, with respect to the end in the knitting width of the knitted fabric held on the needle bed. By setting the boundary in such manner, twisted loops are not formed after joining since the non-joining side boundary is at the same position with respect to the end in the knitting width before and after the joining of the tubular part. As a result, knitting can be continuously performed after the formation of the gores.

Second Embodiment

A second embodiment will be described based on the view of the parts of FIG. 3 and the knitting process drawing of FIG. 4. The second embodiment shows the method of knitting a cardigan. The configuring portions same as the first embodiment are denoted with the same reference numerals in the second embodiment, and description thereof will be omitted.

The second embodiment differs from the first embodiment in that the size of the gore differs between the front and back knitted fabrics and in that the length of the gore of the front knitted fabric is longer than the length of the gore of the back knitted fabric, as shown in FIG. 3. Furthermore, the second embodiment also differs from the first embodiment in that setting is made such that the positions of the boundaries X, Y of the left and right sleeves are both positioned between the front and back needle beds, as shown in step 1 of FIG. 4.

The method of knitting the cardigan of the second embodiment is basically the same as the first embodiment. However, it differs from the first embodiment in that the left sleeve 3 is brought closer to the body 2 without rotating in step 2, the right sleeve 4 is brought closer to the body 2 without rotating in step 5, and knitting is performed so that the number of double stitching and bind-off for forming the gores is greater for the front knitted fabric.

Other knitting and joining methods are performed through the same method as the first embodiment from step 1 to step 9 of FIG. 4.

In the second embodiment, the size of the gores of the front knitted fabric is made larger than the size of the gores of the back knitted fabric. Consequently, the cardigan that fits the shape of the human body can be knitted while knitting the overlapping portions of the open parts of the front body up to above the joining starting position of the body and the sleeves.

In the present invention, the tubular part formed by joining the body and one of the sleeves is rotated to join the other sleeve, as shown in step 5. Thus, when the tubular part in which the body and one of the sleeves are integrated is rotated, the joining portion (Z, Y) is pulled in the direction of separating from each other (step 5).

Therefore, in order to form a wide overlapping portion of the open part, the yarn must not break even when the joining portion is pulled. This problem can be resolved by forming the gores.

The size of the overlapping portions of the open parts might be limited if the gores are not formed, but the overlapping portions of the open parts can be knitted to above the joining starting position of the body 2 and the sleeves 3, 4. In this case, the overlapping portions of the open parts can be slightly enlarged in width direction if elastic yarns or yarns having stretching properties are used for only the portion at where the body 2 and the sleeves 3, 4 are joined, since the yarn of the joining portion stretches even if the joining portion is pulled when the body 2 and the sleeves 3, 4 are rotated.

Third Embodiment

The third embodiment will be described based on the view of the parts of FIG. 5 and the knitting process drawing of FIG. 6. The third embodiment shows the method of knitting a cardigan without gores. The configuring portions same as the first embodiment are denoted with the same reference numerals in the third embodiment, and description thereof will be omitted. In the present embodiment, only the joining portion is joined using the elastic yarn when joining the body 2 and the sleeves 3, 4.

As shown in FIG. 5, the third embodiment differs from the first embodiment in that the body 2 and the left and right sleeves 3, 4 are joined without forming the gores. Furthermore, the third embodiment differs from the first embodiment in that setting is made such that the positions of the boundaries X, Y of the left and right sleeves are both positioned between the front and back needle beds.

In the method of knitting the cardigan of the third embodiment, the knitted fabric of the body 2 is rotated clockwise so that the boundary Z on the side to be joined with the left sleeve 3 is positioned between the front and back needle beds with the overlapping portions of the open parts S1, S2 of the left front body 202*a* and the right front body 201*a* abutted to each other, and the left sleeve 3 is brought close to the body 2 so that the body 2 and the left sleeve 3 are adjacent to each other (step 2). In this case, the boundary Z of the body 2 and the boundary Y of the left sleeve 3 oppose each other between the front and back needle beds with at least one empty needle provided between the body 2 and the left sleeve 3.

From this state, a loop is formed on the loop at the end of the left front body 202*a* using the elastic yarn, and the yarn is hung on the empty needle provided between the body 2 and the back knitted fabric of the left sleeve 3, thereafter, a loop is formed on the loop at the end of the front knitted fabric 3*a* of the left sleeve 3. Next, a loop is formed on the loop at the end of the back knitted fabric 3*b* of the left sleeve 3, and the yarn is hung on the empty needle provided between the body 2 and the front knitted fabric of the left sleeve 3, thereafter, a loop is formed on the loop at the end of the back body 2*b*. The body 2 and the left sleeve 3 are joined to form a single tubular part by forming loops at the end of the knitted fabrics with hanging on edge of the empty needles in this manner (step 2).

After joining the body 2 and the left sleeve 3, the right sleeve 4 is brought close to be adjacent to the body 2. The boundary Z of the body 2 and the boundary Y of the right sleeve 4 oppose each other between the front and back needle beds with one empty needle provided between the body and the right sleeve 4 while rotating the tubular part in which the body 2 and the left sleeve 3 are integrated counterclockwise (step 3).

From this state, a loop is formed on the loop at the end of the right front body 201*a* using the elastic yarn, and the yarn is hung on the empty needle provided between the body 2 and the back knitted fabric of the right sleeve 4, thereafter, a loop is formed on the loop at the end of the front knitted fabric 4*a* of the right sleeve 4. Next, a loop is formed on the loop at the end of the back knitted fabric 4*b* of the right sleeve 4, and the yarn is hung on the empty needle provided between the body 2 and the front knitted fabric of the right sleeve 4, thereafter, a loop is formed on the loop at the end of the back body 2*b*. The body 2 and the right sleeve 4 are joined to form a single tubular part by forming loops at the end of the knitted fabrics with hanging on edge of the empty needles in this manner (step 4).

The tubular part is then rotated counterclockwise so that the non-joining side boundary X on the right sleeve and the non-joining side boundary Y on the left sleeve and the left and right joining parts X, Z and Y, Z are symmetric with the open parts S1, S2 as the center, and the state of step 4 is obtained. The body 2 and the left and right sleeves 3, 4 are then continuously knitted in a tubular form from the above state so as to be joined up to the shoulder part.

The state of step 5 shows a cross section of the completely knitted cardigan in which the shoulder parts are joined at the joining starting position of the body and the sleeves.

In the third embodiment, the position of the boundary on non-joining side of the left and right sleeves 3, 4 after the left and right sleeves 3, 4 are joined to the body to form a single tubular part differs from the position immediately before the start of joining, with respect to the end in knitting width of the knitted fabric held on the needle bed. As a result, the loops transferred from one needle bed to the other needle bed will be twisted.

The loops involved in the shift of the boundary from the position in the state of step 1 to the position in step 4 are preferably twisted in advance at the knitting stage immediately before the start of joining.

When joining the body and the sleeves without forming gores, the body and one of the sleeves may be joined by double stitching one loop between the front knitted fabrics and one loop between the back knitted fabrics, from the boundaries.

Further, when joining the body and the sleeves without forming gores, the body may be knitted so as to have a divided part (a slit) at the upper end thereof before joining, then, the body and the sleeves are joined. In this case, if the joining portion is pulled, such divided portion can hold the pulling force, whereby the size of the overlapping portions of the open parts can be enlarged. When the slit is formed in the body, the slit portion is sewed and joined after the knitting of the knitwear is completed.

In the case of forming the gores with the bind-off process similar to the first and the second embodiments, the elastic yarn may also be used as in the first embodiment. Furthermore, the slit may be formed at the upper end of the side part of the body even when the gores are formed. Still further, when the gores are formed, the slit may be formed at the upper end of the side part of the body and the elastic yarn may be used in the bind-off process as well.

INDUSTRIAL APPLICABILITY

The knitting method of the present invention is suited to a case of knitting knitwear with the open part in the body tubular part knitted in a seamless manner using the flat knitting machine, in particular, an open front knitwear such as cardigan and jacket.

EXPLANATION OF LETTERS OR NUMERALS

Figure 1:
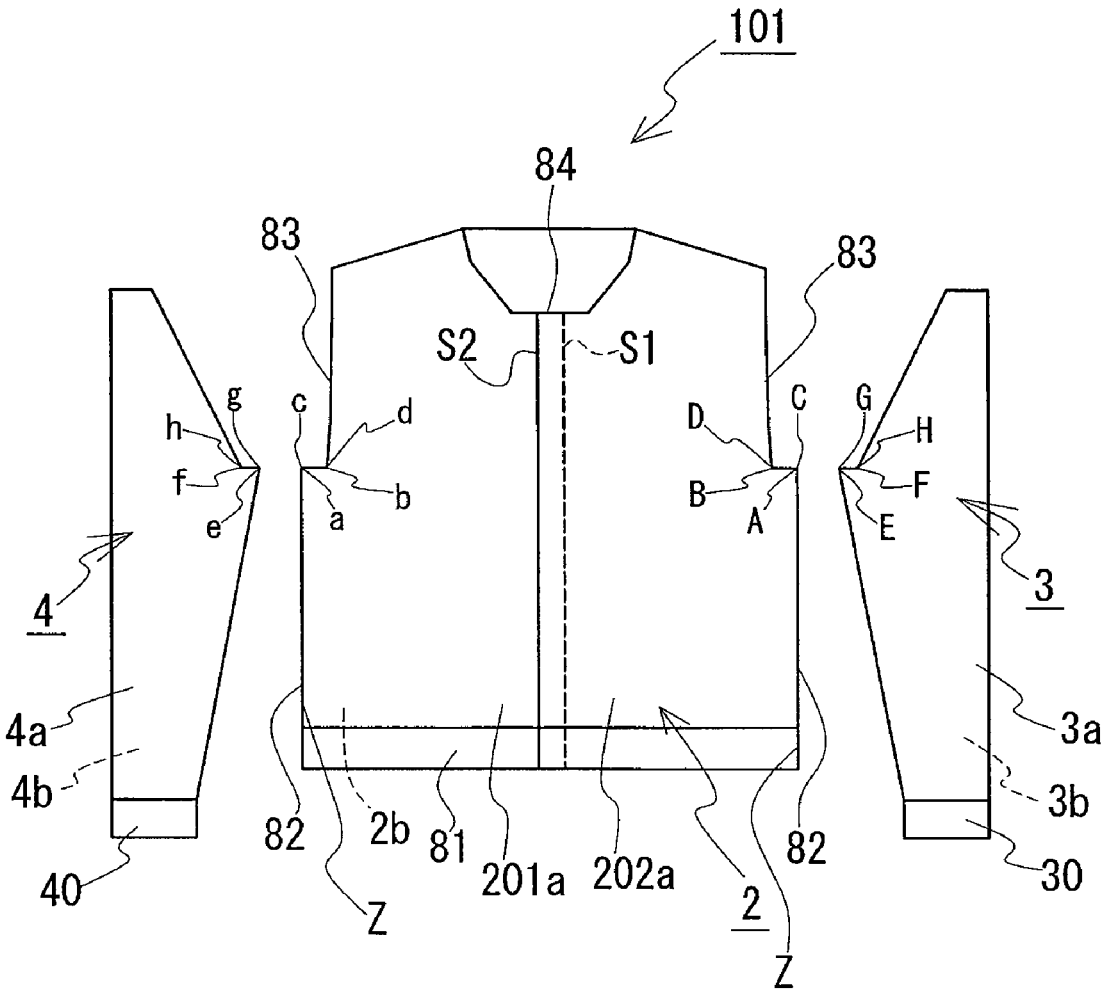
FIG. 1 is a view of parts of a cardigan according to a first embodiment of a method of knitting a cardigan of the present invention.
Figure 2:
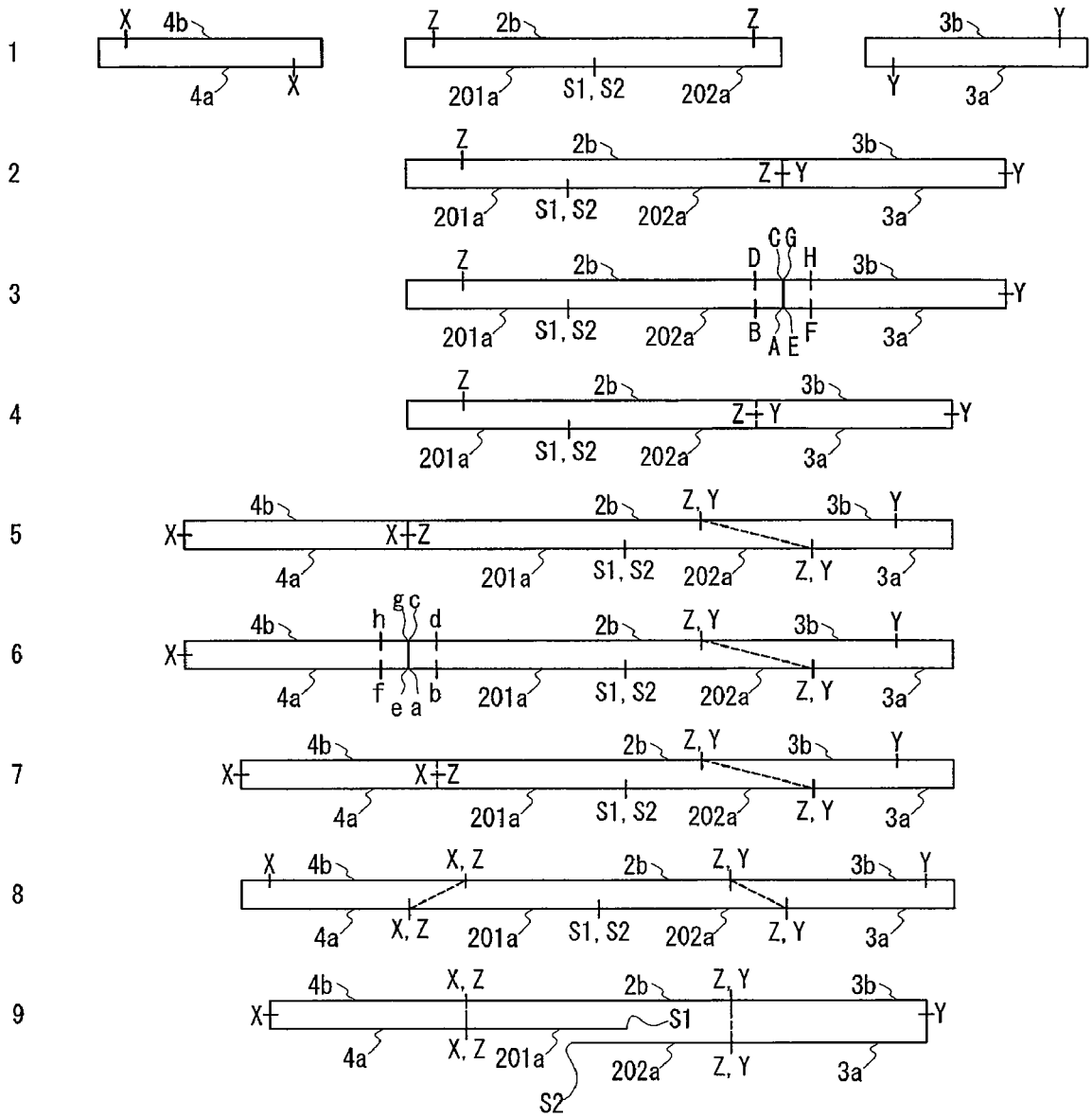
FIG. 2 is a knitting process drawing of the cardigan according to the first embodiment.
Figure 3:
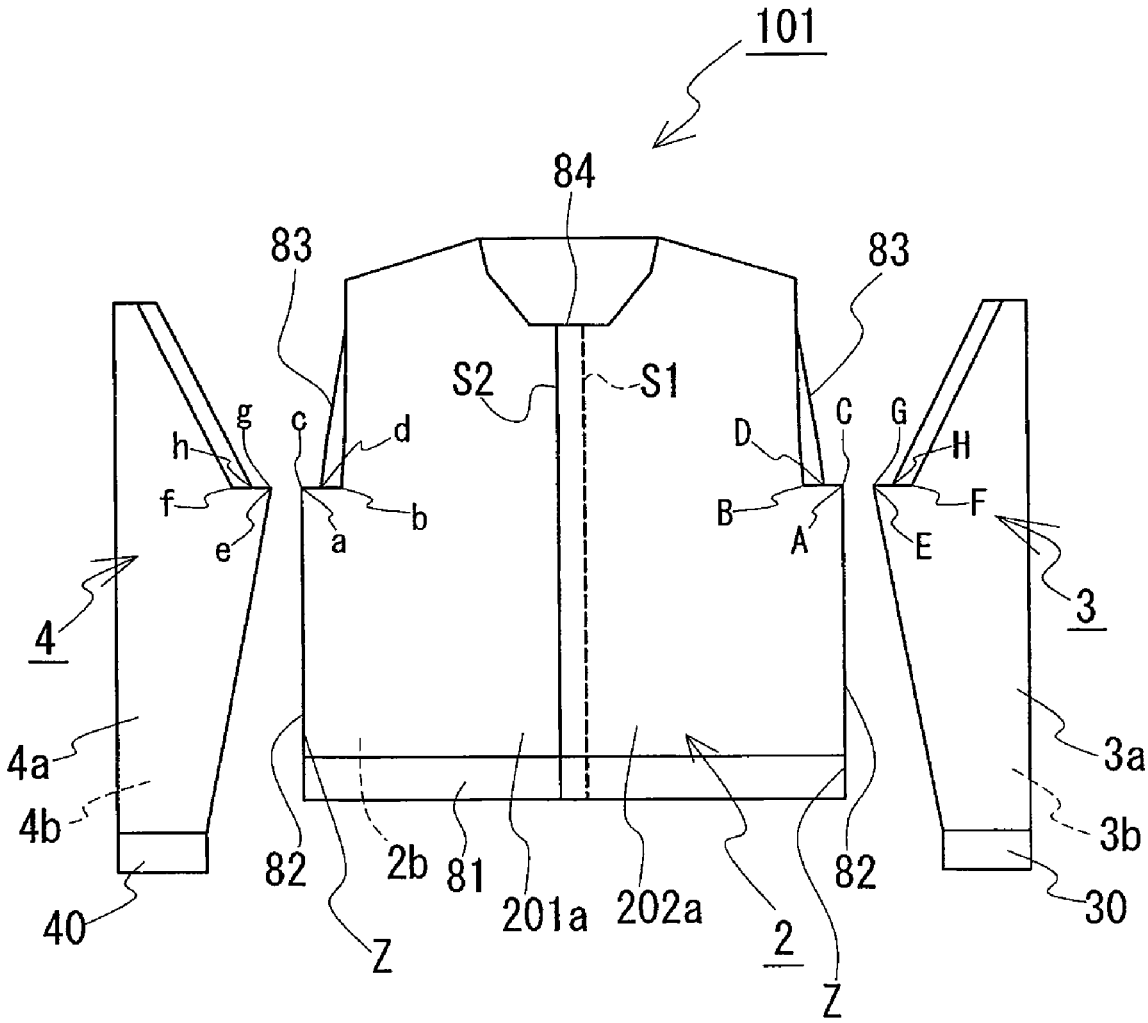
FIG. 3 is a view of parts of a cardigan according to a second embodiment of a method of knitting the cardigan of the present invention.
Figure 4:
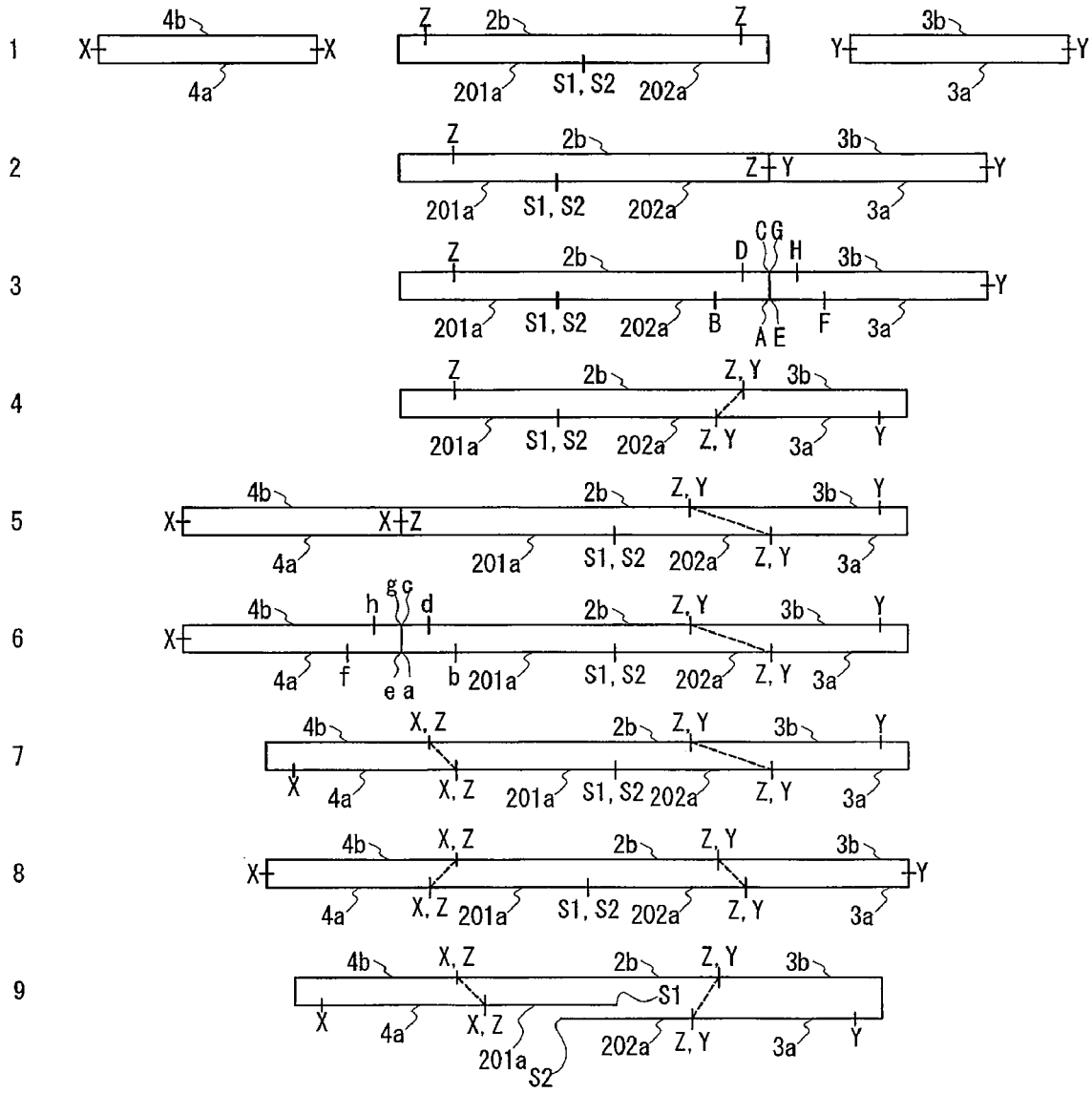
FIG. 4 is a knitting process drawing of the cardigan according to the second embodiment.
Figure 5:
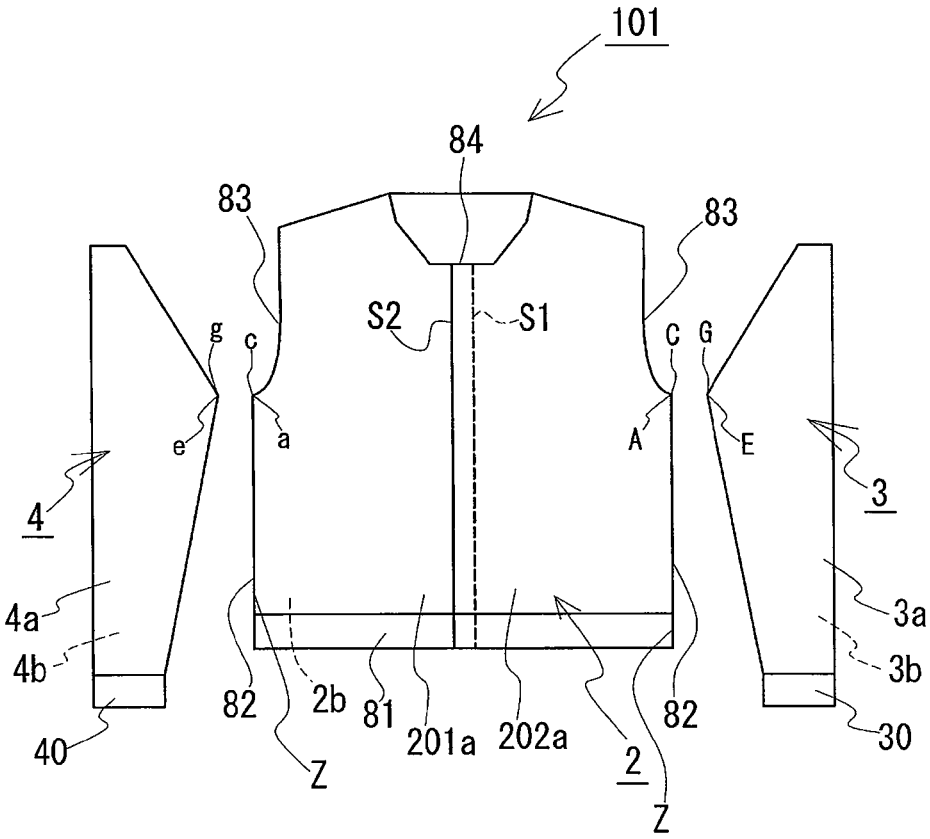
FIG. 5 is a view of parts of a cardigan according to a third embodiment of a method of knitting the cardigan of the present invention.
Figure 6:
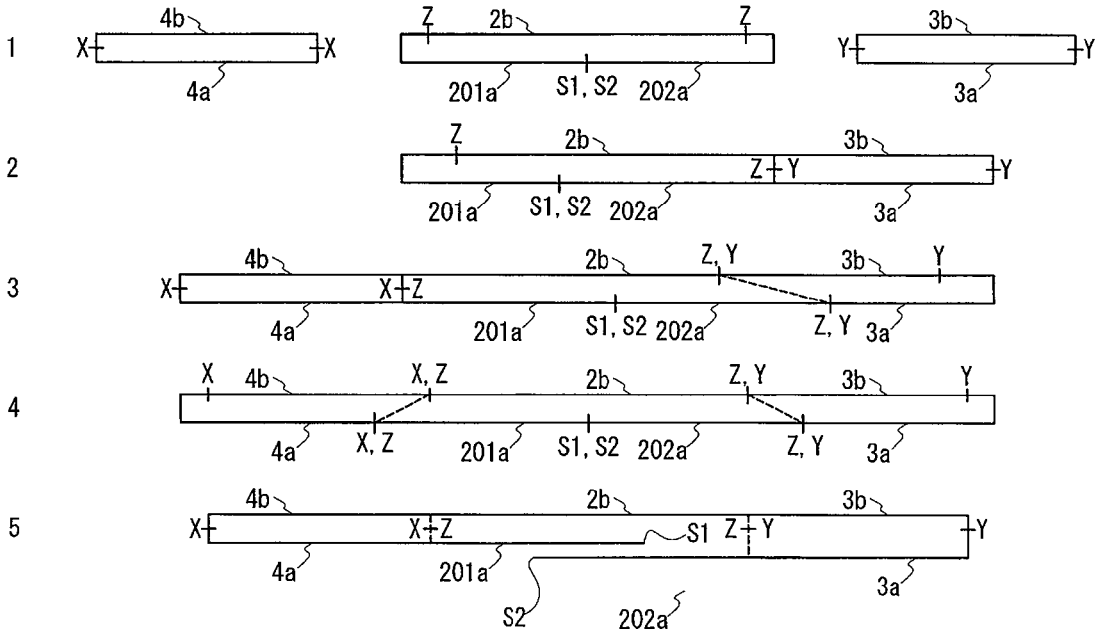
FIG. 6 is a knitting process drawing of the cardigan according to the third embodiment.

101 cardigan
2 body
201*a* right front body
202*a* left front body
2*b* back body
81 hem part
82 side part
83 armhole part
84 neckline part
3 left sleeve
3*a* front knitted fabric
3*b* back knitted fabric
30 cuff part
4 right sleeve
4*a* front knitted fabric
4*b* back knitted fabric
40 cuff part
X, Y, Z boundary S1, S2 open part

The invention claimed is:

1. A method of knitting a knitwear having an open part in a body tubular part and formed by joining the body tubular part and sleeve tubular parts using a flat knitting machine having a pair of front and back needle beds extending in a transverse direction and disposed opposite to each other in a cross direction, at least one of which is capable of being racked in the transverse direction so that loops can be transferred between the front and back needle beds; the method comprising the steps of:

a) knitting the body tubular part having a front body and a back body by return knitting up to a joining starting position to form a tubular part with the open part as a turn-back position on the knitwear, wherein either the front body or the back body is divided into a right body and a left body, overlapping portions of the open parts of the bodies are abutted to each other, one of the front or back bodies does not have the open part, one of the front and back needle beds holds loops of the one of the front or back bodies not having the open part, and a boundary of knitted fabric of the front body and knitted fabric of the back body is positioned on the one of the front and back needle beds holding loops of the one of the front or back bodies not having the open part;

b) rotating the body tubular part so that one of the left and right boundaries of the body tubular part is positioned between the front and back needle beds;

c) joining the body tubular part and one of the left and right sleeve tubular parts to form one tubular part with one of the boundaries of the body tubular part and a joining side boundary of the sleeve tubular part facing each other;

d) rotating the tubular part formed in step c so that the other boundary of the body tubular part is positioned between the front and back needle beds;

e) joining the body tubular part and the other sleeve tubular part to form one tubular part with the other boundary of the body tubular part and a joining side boundary of the sleeve tubular part facing each other; and f) knitting the tubular part formed in step e by return-knitting towards shoulder parts with the open part as a turn-back position.

2. The method of knitting the knitwear having the open part in the body tubular part according to claim 1, wherein the sleeve tubular part is set so that the boundary of the knitted fabrics of the front and back bodies on the side to be joined with the body tubular part is positioned on one of the needle beds immediately before joining; and the sleeve tubular part is also rotated in step b and step d of claim 1 so that the boundary of the sleeve tubular part is positioned between the front and back needle beds.

3. The method of knitting the knitwear having the open part in the body tubular part according to claim 1, wherein the body tubular part and the sleeve tubular parts are joined by double stitching loops between the knitted fabric of the front body and loops between the knitted fabric of the back body in step c and in step e of claim 1.

4. The method of knitting the knitwear having the open part in the body tubular part according to claim 1, wherein the body tubular part and the sleeve tubular parts are joined while forming gores by performing double stitching and bind-off processing for loops between the knitted fabric of the front body and loops between the knitted fabric of the back body, with the boundary interposed therebetween.

5. The method of knitting the knitwear having the open part in the body tubular part according to claim 4, wherein the size of the gore differs between the knitted fabrics of the front and back bodies.

6. The method of knitting the knitwear having the open part in the body tubular part according to claim 1, wherein the front body of the body tubular part is divided into a right front body and a left front body and the open part is formed in the front body;

the knitted fabrics of the front and back bodies of the body tubular part are knitted in a tubular form by return knitting with the overlapping portions of the open parts abutted to each other; and the body tubular part is knitted so that the overlapping portions of the open parts are formed from a hem to above the joining starting position of the body tubular part and the sleeve tubular parts.

7. An open front knitwear in which a body and sleeves are knitted in a seamless manner using a flat knitting machine in which needle beds provided with a great number of knitting needles are disposed opposite to each other in a cross direction; wherein a front body is divided into a right front body and a left front body;

an open part is formed in the right front body and the left front body; and a body tubular part is knitted so that overlapping portions of the open parts are formed from a hem part to above a joining starting position of the body tubular part and tubular parts of the sleeves.

* * * * *